US005411369A

United States Patent [19]

Bouchard

[11] Patent Number: 5,411,369

[45] Date of Patent: May 2, 1995

[54] GAS TURBINE ENGINE COMPONENT RETENTION

[75] Inventor: Jean G. Bouchard, Mont-St-Hilaire, Canada

[73] Assignee: Pratt & Whitney Canada, Inc., Longueuil, Canada

[21] Appl. No.: 164,335

[22] Filed: Feb. 22, 1994

[51] Int. Cl.[6] ..... E01D 9/04

[52] U.S. Cl. ..... 415/189; 415/209.4; 415/209.2

[58] Field of Search ..... 415/189, 190, 209.2, 415/209.3, 209.4; 416/218

[56] References Cited

U.S. PATENT DOCUMENTS 3,104,091 9/1963 Vivian ..... 415/190
4,006,659 2/1977 Wurzel et al. .
4,389,161 6/1983 Brumen ..... 416/218
4,425,078 1/1984 Robbins .
5,004,402 4/1991 Burchette et al. ..... 415/209.2
5,131,813 7/1992 Przytulski et al. ..... 416/218
5,232,340 8/1993 Morgan ..... 415/209.2

FOREIGN PATENT DOCUMENTS 804010 11/1958 United Kingdom ..... 415/209.3

*Primary Examiner*—Thomas E. Denion
*Assistant Examiner*—James A. Larson
*Attorney, Agent, or Firm*—Edward L. Kochey, Jr.

[57] ABSTRACT

A split retaining ring 22 has deep internal scallops 26 which clear lugs 36 during installation while the ring fits within lip 40. The ring is opened with ridges 30 clearing lugs 36 while the ring is rotated. Shallow internal scallops rest on and lock with lugs 36 in the final position.

6 Claims, 4 Drawing Sheets

GAS TURBINE ENGINE COMPONENT RETENTION

TECHNICAL FIELD

The invention relates to gas turbine engines and in particular to an arrangement where a split ring retains a component from downstream movement.

BACKGROUND OF THE INVENTION

When a static component is mounted within the housing of a gas turbine engine at a location upstream of a moving component, it is critical that the static component be unambiguously retained from downward movement. When a retaining ring is used to provide axial retention of such static turbine components, it is normally recommended that it be secured in the eventuality of a malfunction such as the ring collapsing. Securing of this ring is usually achieved by providing an extra lip on the next part of the assembly which overlaps and prevents the ring from falling out of it's groove. This practice requires extra weight for the component performing this function and passing by the rotating part. At other times it is difficult or even impossible in certain designs.

SUMMARY OF THE INVENTION

A static component is to be retained within a static housing from downstream movement. The housing has a base diameter at an upstream location followed by a circumferential groove with a groove diameter and an inwardly extending lip with an intermediate lip diameter at a downstream location.

The static component to be retained fits within the housing, with the rim of an outside diameter greater than the base diameter to prevent it from moving upstream. Axially projecting lugs on the static component have outer edges forming an outside diameter less than the lip diameter so that the component may be placed within the housing from the upstream end.

A split retaining ring has a plurality of deep scallops which clear the lugs as the ring is passed inside the lip. It has a plurality of shallow scallops which rest on the lugs in the installed position and take shear between the static housing and the static component. Ridges separate the scallops and are sized to clear the diameter formed by the lugs with the ring fitting within the slot. The ring therefore may be rotated after installation so that the shallow scallops clock with and lock against the lugs, preventing rotation of the ring.

DESCRIPTION OF THE PREFERRED EMBODIMENT

Figure 1:
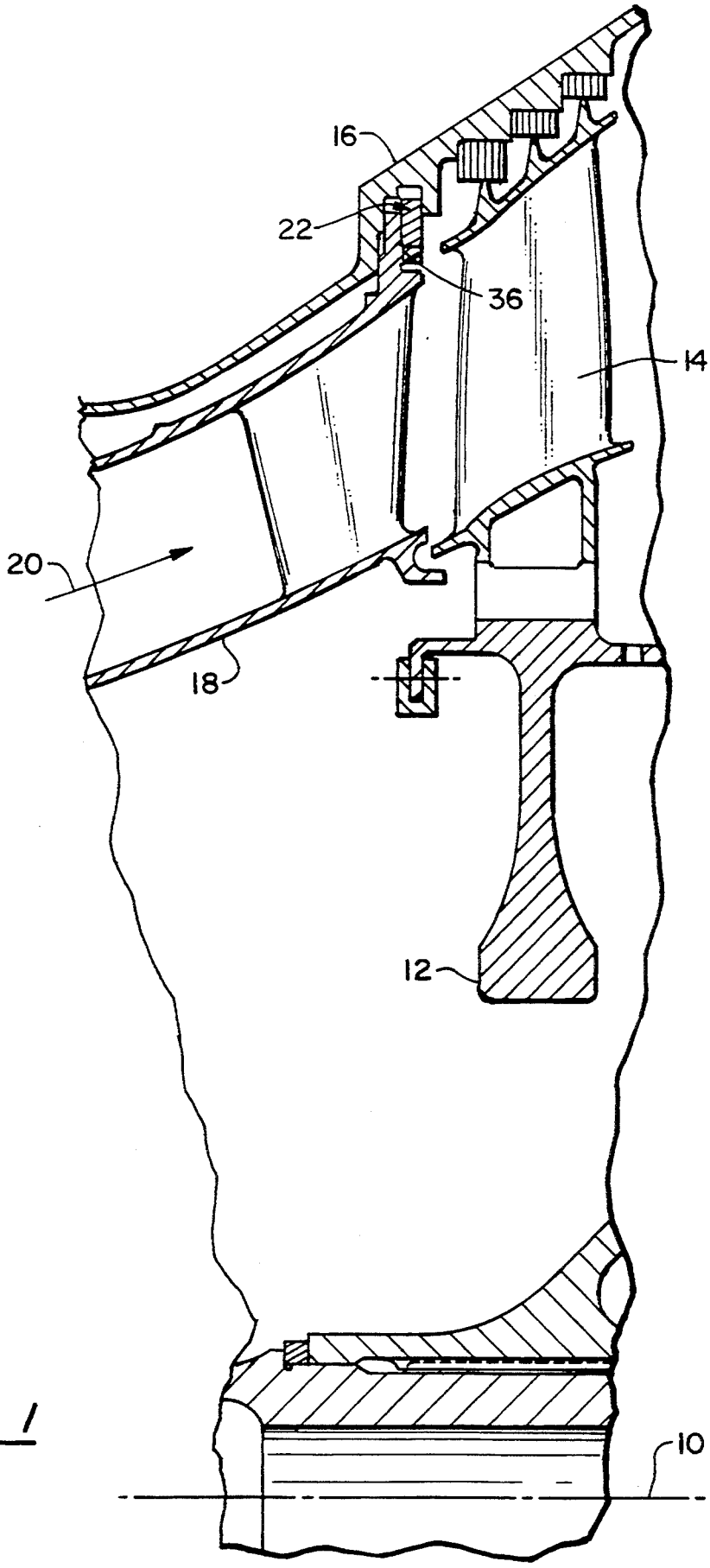
FIG. 1 is a sectional side view of a portion of a gas turbine engine.

In FIG. 1 there is shown a gas turbine engine with an axial centerline 10 around which rotor 12 rotates carrying blades 14. Within the static housing 16 there is located a static component 18 in the form of vanes. During operation gas flow passes in the direction shown by arrow 20 from an upstream location to a downstream location. The static component 18 is installed by moving it within the housing from an upstream location. The retaining ring 22 which holds the static component within the housing is better shown in its relationship to the housing and static structure in FIGS. 3 and 4 while the ring itself is shown in FIG. 2.

Figure 2:
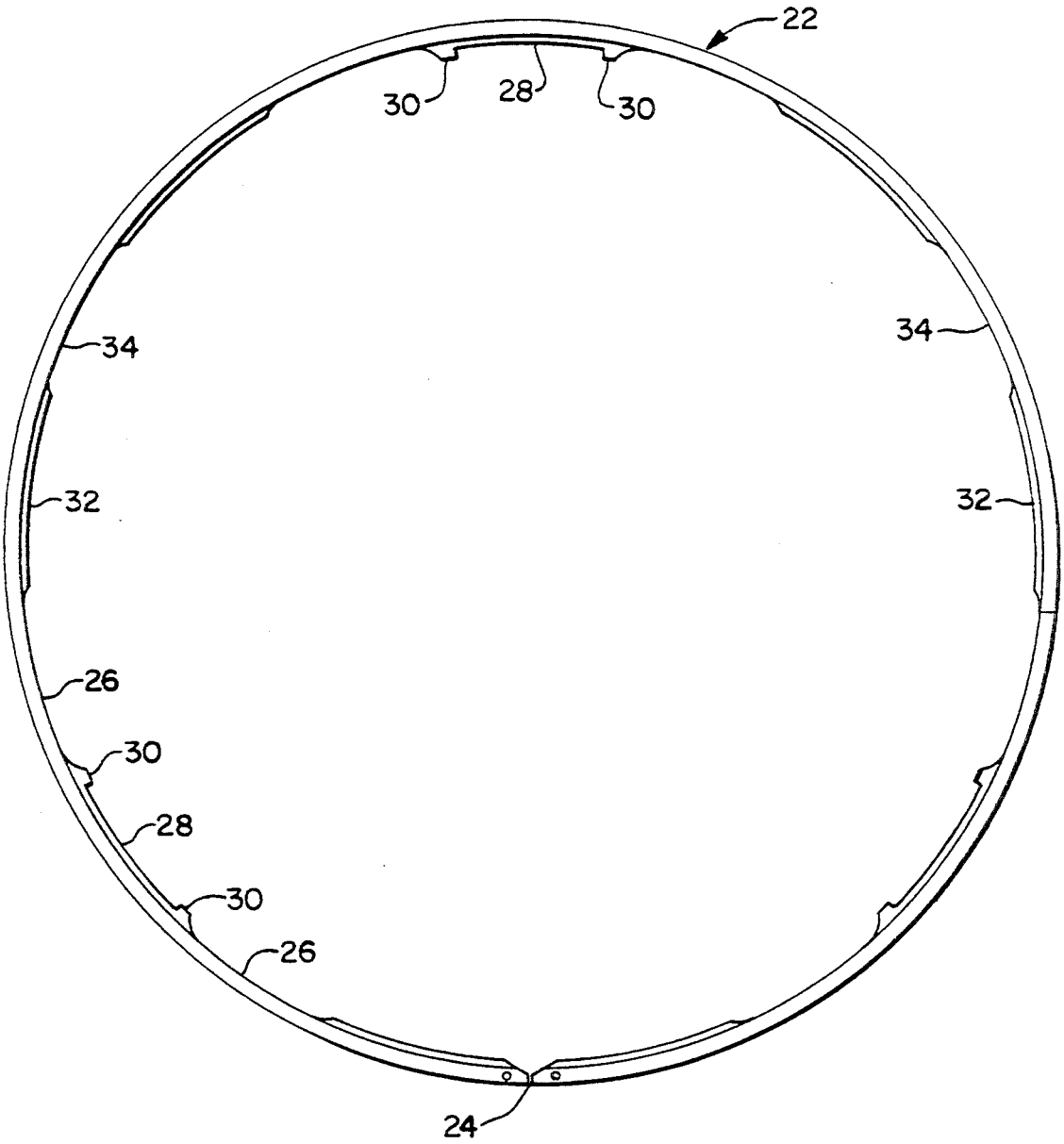
FIG. 2 is a front view of the retention ring.

Referring to FIG. 2 the retaining ring 22 is in the form of a split ring with a split opening 24 in the ring. This permits it to be open and closed varying the diameter, and the ring is formed so that it tends to return to its closed position, at least in the installed position.

At three locations on the ring there is shown deep scallops 26 and shallow scallops 28 separated by ridges 30. The term scallop here is used to refer to the material facing inwardly from the inside diameter of the ring as it remains after cuts are made. The material extending further inwardly is referred to as ridges 30. Furthermore, the term scallops is retained for shallow scallop 32 and deep scallop 34 even though there is no ridge separating these at some locations. This term is used to avoid the language problems involved in referring to a multiplicity of diameters.

As described hereinafter the scallops 28 rest on lugs of the static component while lips 30 prevent inadvertent rotation of the ring. Shallow scallops 32 provide additional material to supply shear resistance during operation.

Figure 3A:
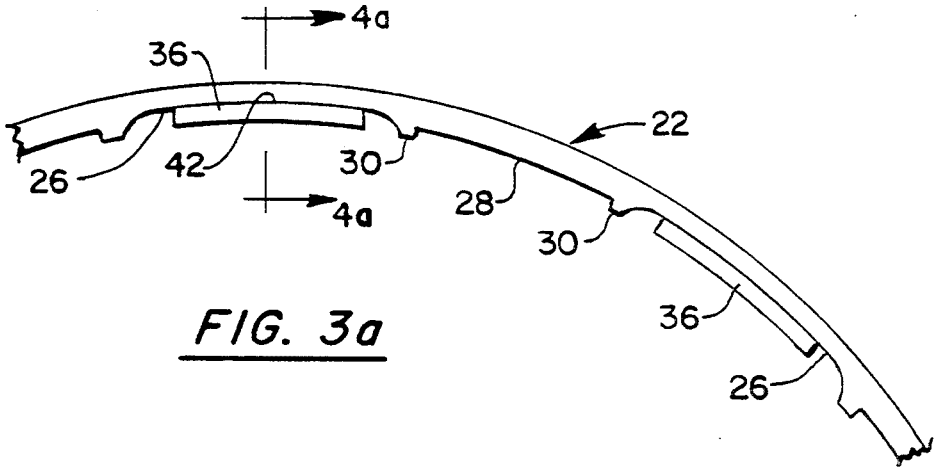
FIGS. 3(*a*), (*b*) and (*c*) are front views showing the ring installation.
Figure 3B:
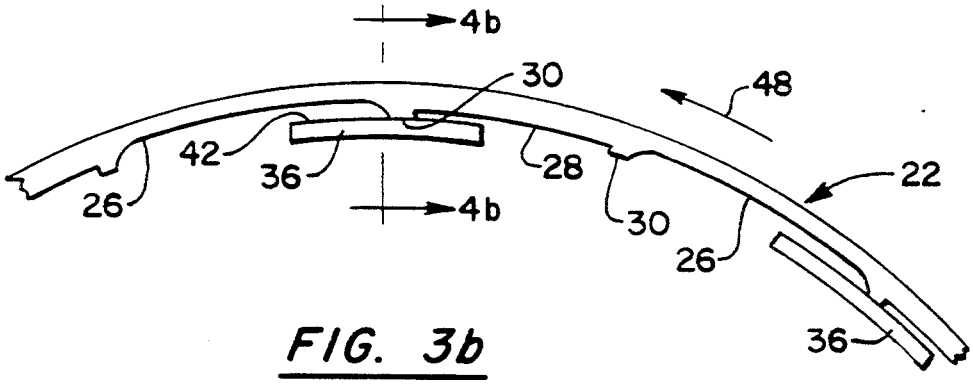
Figure 3C:
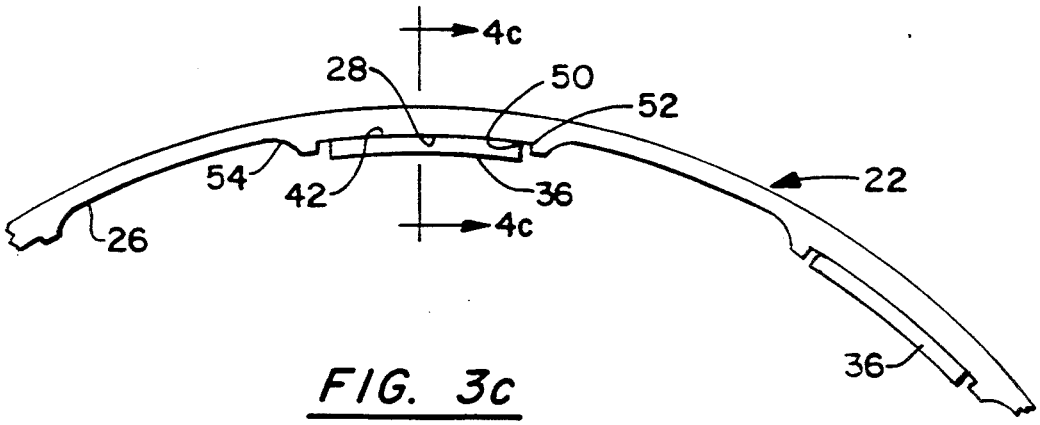
Figure 4C:
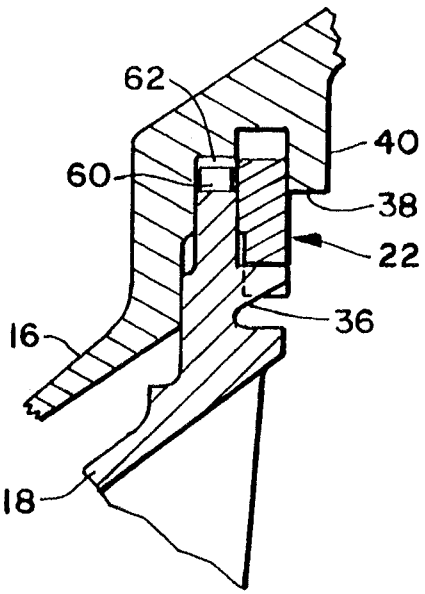
FIGS. 4(*a*), (*b*) and (*c*) are sections through FIGS. 3(*a*), (*b*) and (*c*).
Figure 4B:
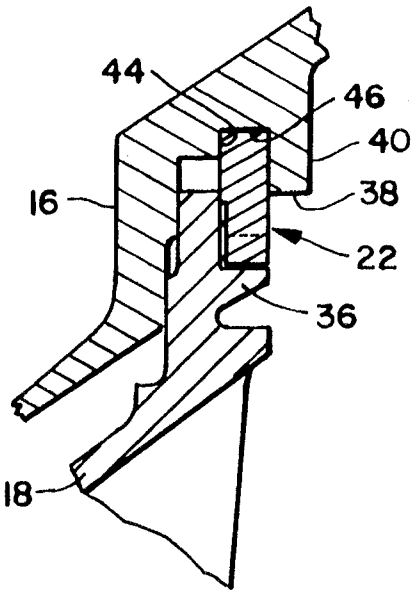
Figure 4A:
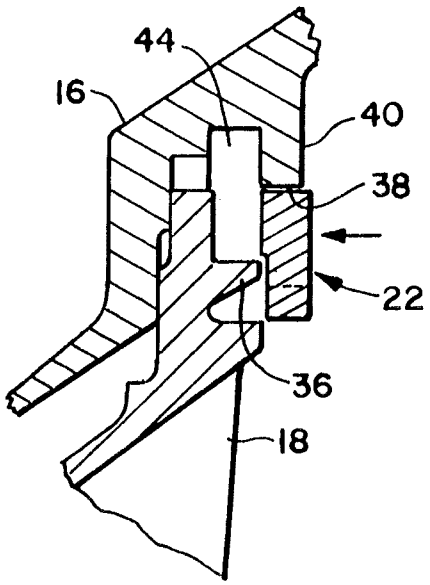

The static component 18 has at least three and preferably six lugs 36 extending axially upstream. FIGS. 3 and 4 show the various steps in the procedure of installing the split ring.

With the static component positioned within the static housing, the split ring is moved in axially from an upstream position as shown in FIGS. 3 and 4(*a*). The maximum outside or rim diameter of the static component 18 is greater than the base diameter of the static structure at an upstream location. This base diameter is that diameter of the structure which prevents the static component from moving upstream. The ring is opened up so that it's outside diameter is substantially the same as the inside intermediate lip diameter 38 of inwardly extending lip 40 of the static structure. Deep scallops 26 are clocked and sized so that with the ring at this diameter these scallops clear the outside diameter 42 formed by the lugs 36. This ring may then be slid axially against the static component 18 to a position in line with circumferential groove 44 located in the static housing.

As shown in FIGS. 3 and 4(*b*) the ring is then opened up with the outside diameter of the ring moved to the outside groove diameter 46 of groove 44. At this point ridges 30 are of such a diameter that they clear the outside diameter 42 of lugs 36. The ring 22 is rotated as indicated by arrow 48 to achieve the final clocked position.

This final position is shown in FIGS. 3 and 4(*c*) where the shallow scallop 28 is shown resting on the outside diameter 42 of lugs 36. Lugs 36 have a square corner 50 at the radially outside edge which interacts with a square corner 52 at each edge of shallow scallops 28. As described before the ring 22 is sized so that it is self biased inwardly at this installed position. The sharp corners 50 and 52 further aid in preventing rotation of ring 22 away from this locked position.

The deep scallops 26 have a rounded corner 54 at each edge for the purpose of facilitating the rotation during installation and avoiding hangup on the corners.

The retaining ring resists any axial load from static component 18 by operating in shear against static housing 16. Shallow scallops 28 and 32 provide the material for resisting in shear.

FIGS. 3 and 4 show adjacent scallops with ridges while FIG. 2 does not. Only a few rigid scallops are needed to resist rotation.

The static component 18 also has at least one ear 60 extending radially outward and circumferentially interacting with a portion of the static housing in the form of a projection 62. This avoids rotation of the static component relative to the static housing. The lip 40 is provided, as necessary, with slot(s) to clear the ear 60 of the static component.

Thus a self securing or self locking ring is provided which achieves a lightweight structure and reliably secures the static component within the static housing from downstream movement.

I claim:

1. A retention arrangement for axially retaining a static component from downstream movement in a gas turbine engine, comprising:

a static housing having a base diameter at an upstream location, a circumferential groove having a groove diameter larger than said base diameter downstream of said base diameter, and an inwardly extending lip downstream of said groove having an inside intermediate lip diameter;

said static component fitting within said housing and having a rim diameter greater than said base diameter;

axially projecting lugs on said static component, the outer edges of said lugs forming an outside diameter less than said lip diameter;

a split retaining ring having a plurality of deep scallops and a plurality of shallow scallops located on the inside edge of said ring and at least some of said scallops separated by ridges;

said deep scallops spaced to clock with and sized to clear said lugs when said ring is opened to an outside diameter equal to the inside intermediate lip diameter;

said ridges sized to clear the outside diameter formed by said lugs with said ring fitting in said circumferential groove; and said shallow scallops spaced to clock with and sized to rest on said lugs with the outside diameter of said ring greater than said inside intermediate lip diameter.

2. An arrangement as in claim 1 further comprising:

said lugs having square corners at the outside edge of each lug; and said shallow scallops having square corners at each edge of each shallow scallop.

3. A retention arrangement as in claim 1 further comprising:

said deep scallops having a rounded corner at each edge of each deep scallop.

4. A retention arrangement as in claim 2 further comprising:

said deep scallops having a rounded comer at each edge of each deep scallop.

5. A retention arrangement as in claim 3 further comprising:

said static component having at least one ear extending radially outward and circumferentially interacting with a portion of said static housing, whereby rotation of said static component relative to said static housing is prevented.

6. A retention arrangement for axially retaining a static component from downstream movement in a gas turbine engine, comprising:

a static housing having a circumferential groove having a groove diameter, and an inwardly extending lip downstream of said groove having an inside intermediate lip diameter;

said static component fitting within said housing and having a rim diameter;

axially projecting lugs on said static component, the outer edges of said lugs forming an outside diameter less than said lip diameter;

a split retaining ring having a plurality of deep scallops and a plurality of shallow scallops located on the inside edge of said ring and at least some of said scallops separated by ridges;

said deep scallops spaced to clock with and sized to clear said lugs when said ring is opened to an outside diameter equal to the inside intermediate lip diameter;

said ridges sized to clear the outside diameter formed by said lugs with said ring fitting in said circumferential groove; and said shallow scallops spaced to clock with and sized to rest on said lugs with the outside diameter of said ring greater than said inside intermediate lip diameter.

* * * * *

UNITED STATES PATENT AND TRADEMARK OFFICE
CERTIFICATE OF CORRECTION

PATENT NO. : 5,411,369

DATED : May 2, 1995

INVENTOR(S) : Jean Guy Bouchard

It is certified that error appears in the above-identified patent and that said Letters Patent is hereby corrected as shown below:

In the claims:

claim 4, column 4, line 14, delete "comer" and insert --corner--

Signed and Sealed this

Fifth Day of December, 1995

*Attest:*

Bruce Lehman

BRUCE LEHMAN

*Attesting Officer*

*Commissioner of Patents and Trademarks*